US006204598B1

(12) United States Patent
Bruggemann et al.

(10) Patent No.: US 6,204,598 B1
(45) Date of Patent: Mar. 20, 2001

(54) ELECTRIC INCANDESCENT LAMP WITH SINTERED GLASS PLATE

(75) Inventors: Ursula Bruggemann, La Gault Saint-Denis (FR); Wilfried L. Kohlmann, Aldenhoven (DE); Jacques M.J. Geboers, Champhol (FR); Antonius J.M. Van Hees, Eindhovon (NL)

(73) Assignee: U.S. Philips Corporation, New York, NY (US)

( * ) Notice: Subject to any disclaimer, the term of this patent is extended or adjusted under 35 U.S.C. 154(b) by 0 days.

(21) Appl. No.: 09/421,348

(22) Filed: Oct. 19, 1999

(30) Foreign Application Priority Data

Oct. 22, 1998 (EP) ..... 98402635

(51) Int. Cl.[7] ..... H01K 1/28

(52) U.S. Cl. ..... 313/315; 313/578; 313/624; 313/569; 313/573

(58) Field of Search ..... 313/624, 578, 313/579, 315, 316, 318.08, 569, 573

(56) References Cited

U.S. PATENT DOCUMENTS 2,175,361 * 10/1939 Reger et al. ..... 313/25
3,247,417 * 4/1966 Wollank et al. ..... 313/578
3,904,916 * 9/1975 Emidy et al. ..... 313/624

FOREIGN PATENT DOCUMENTS 913579 6/1946 (FR) .

* cited by examiner

*Primary Examiner*—Michael H. Day
(74) *Attorney, Agent, or Firm*—F. Brice Faller

(57) ABSTRACT

The electric incandescent lamp has a sintered glass plate (1) through which current conductors (2) and a metal tube (3) extend. An incandescent body (4) is connected to said current conductors (2) aligned with respect to the sintered plate (1). A glass bulb (5) is present over the incandescent body (4), gastight secured to the sintered plate (1) by means of enamel (6). A water getter (20) and a heavy gas at an elevated pressure are present inside the glass bulb (5). The lamp may consume a relatively high power and may be relatively small, but nevertheless has a relatively long life.

13 Claims, 2 Drawing Sheets

ELECTRIC INCANDESCENT LAMP WITH SINTERED GLASS PLATE

BACKGROUND OF THE INVENTION

The invention relates to an electric incandescent lamp comprising:

- a shaped glass plate which is connected in a gastight manner to current conductors and to a metal tube which extend through said plate;
- an incandescent body occupying a predetermined position relative to the shaped plate and connected to the current conductors;
- a glass bulb around the incandescent body, connected in a gastight manner to the shaped plate by means of enamel;
- a filling gas having a pressure of at least 1 bar inside the bulb, said metal tube having a gastight seal outside the bulb.

Such an electric incandescent lamp is known from FR-B-913,579.

The known lamp has a molded or pressed glass plate with a circular edge with a locating stud thereon. The lamp is designed for being passed with its bulb in front through an opening in a reflector and for being pressed home with the edge of the plate against a boundary of the opening. The reflector with the lamp may be used as a motor vehicle headlamp for generating a passing beam and a driving beam.

It is a disadvantage of the known electric lamp that the shaped glass plate can only be manufactured with wide dimensional tolerances. This means that the position of the incandescent body is also badly defined.

It is desirable in other applications of incandescent lamps, for example at the rear of vehicles such as motor cars, to have available electric incandescent lamps which can be moved backwards, i.e. with a lamp cap or base in front, against a carrier, and whose incandescent body then occupies an accurately defined position relative to this carrier with the bulb facing away from the carrier. Such lamps may be used for the stoplight, the taillight, the reversing light, the rear fog lamp, the indicator lights, etc.

Known electric incandescent lamps for these functions are provided with lamp caps. The incandescent body thereof has a position which is defined within no more than wide limits relative to the lamp cap, and the lamps have a comparatively short life. In addition, there is a comparatively high early failure rate owing to lamp leaks.

SUMMARY OF THE INVENTION

It is an object of the invention to render possible an accurate, predetermined position of the incandescent body relative to the shaped glass plate as well as a compact construction.

According to the invention, this object is achieved in that the shaped glass plate is a sintered body made of a first glass and the bulb is made of a second glass, the first glass and the second glass have coefficients of linear thermal expansion which correspond to each other.

The sintered glass plate can be manufactured to a high dimensional accuracy. The current conductors and the metal tube may be present right from the start and may be passed through the glass in a gastight manner in that case. The sintered glass plate has the further advantage that it has a light color, for example white or a pale grey, so that it reflects incident light. It is prevented thereby that the light incident thereon is lost to the light beam which may be formed by means of a reflector.

After the sintered glass plate and the glass bulb are joined, they cool down to a temperature below which they are liable to build up permanent stresses. This temperature is generally known as the strain point, e.g. for a soft glass with a coefficient of linear thermal expansion of about $10*10^{-6}$ $K^{-1}$ a normal strain point is about 500° C. The correspondence in coefficients of linear thermal expansion of the first and the second glass, meaning a relatively small difference in these coefficients at least in a temperature range below the strain points of the respective glasses, avoids the built up of high permanent stresses. A large difference would unavoidably lead to high permanent stresses in both the sintered glass plate and the glass bulb due to a different absolute shrinking of these two joined glass parts. Such high permanent stresses enhance the risk of crack formation in the glass and a subsequent early failure of the lamp. Therefore a generally accepted limit in the difference in the coefficients of linear thermal expansion by men skilled in the art is $0.7*10^{-6}$ $K^{-1}$. Preferably the difference is less than $0.5*10^{-6}$ $K^{-1}$.

For the ease of manufacturing of the lamp the two glasses should have correspondent softening points, the temperature at which the glass deforms under its own weight. The softening points should be high enough so that both the sintered glass plate and the glass bulb should be able to retain their shape when they are connected by means of the enamel.

The lamp has a comparatively long life thanks to the filling gas pressure above 1 bar. It is favorable to choose the pressure of the filling gas at room temperature to lie between 2 and 15, in general between 2 and 8 bar, for example between 3 and 5 bar. It is furthermore favorable for lamp life and also for counteracting a decrease in the luminous flux of the lamp caused by blackening of the bulb owing to deposits of tungsten evaporated from the incandescent body when the filling gas comprises Xe, Kr, or a mixture thereof, for example in the ratio in which they are present in the air, i.e. approximately 6% Xe by volume. The evaporation of tungsten is strongly hampered by the high molecular weight of these gases and by their pressure, so that it is possible to use a comparatively small bulb while achieving a high luminous maintenance. This renders it possible to give the lamp a very small constructional height, so that luminaires in which the lamp will be accommodated may be comparatively flat. The lamp may have, for example, a dimension of less than 2 cm from the outside of the sintered glass plate to the top of the bulb.

It may be favorable for the filling gas to comprise a few % of $N_2$ by volume for preventing breakdown, for example in the case of a comparatively high burning voltage, for example of 24 V or more. It may also be favorable to add a halogen or halogen compound to the filling gas so as to prevent blackening of the bulb.

In a favorable embodiment, a water vapor getter is present in the bulb. The water vapor getter may be provided on the sintered glass plate or against a current conductor, but a particularly convenient getter is formed by a coating on at least one of the current conductors. The water vapor getter renders it possible to heat the bulb and the sintered plate to a comparatively high temperature and thus to dissipate comparatively high powers in a comparatively small bulb. The lamp is accordingly capable of dissipating powers of up to approximately 25 W at said small dimensions. Water vapor released from the glass is bound by the getter, so that it is prevented that a water vapor cycle will arise in the lamp, transporting tungsten from the incandescent body to the sintered plate and to the bulb wall.

It is attractive if the closure of the metal tube is a solidified molten metal. It is possible in that case to seal off lamps in a clean atmosphere, for example in a gastight chamber, for example by means of a laser. Another possibility is that a drop of metal is deposited, for example of tungsten, whereby, for example, a TIG weld is obtained. These methods of providing gastight seals have the advantage that they can be realized quickly and are very reliable. A metal tube has the advantage that it and its seal are not very vulnerable, and that the tube can be sealed off while strain therein is avoided.

In a favorable embodiment, the incandescent body is connected to the current conductors by means of a solidified molten metal. This embodiment not only has the advantage over alternative embodiments, such as pinches or resistance welds, that it can be quickly realized and is reliable, but also that it is accurate. The incandescent body may be brought into an accurate, previously defined position relative to the sintered plate in that case, preferably relative to an outer surface thereof facing away from the bulb, ends of the incandescent body being moved to adjacent the current conductors, and not necessarily against them. In the latter case, the molten metal bridges the gap between the current conductors and the ends of the incandescent body, interconnecting the two by its solidification. The molten metal may be provided from the exterior, for example molybdenum, for example through a dispenser, in the so-called drop deposition process, but alternatively the current conductor itself may be made to melt, for example by means of a laser, beyond the end of the incandescent body as seen from the sintered plate.

In a favorable embodiment, the current conductors each have a weld adjacent the sintered plate between a first conductor part which is made from a first metal and which enters the bulb through the sintered plate and a second part made from a second metal which extends towards the incandescent body. This embodiment has the advantage that the second part may be provided, for example by means of a butt weld, after the sintered plate has been manufactured. The second part in that case is not exposed to the temperatures necessary for manufacturing the sintered plate and may accordingly have a greater rigidity than the first part, given the same thickness, because it has not been soft-annealed. An important advantage of this is that this embodiment affords a wide freedom of choice in e.g. the diameter and the type of conductive material of the second part. Thus the second part may be chosen, for example, to have a comparatively small diameter so as to prevent this part from forming a shadow in the generated light beam.

It is favorable when the bulb has a spherical end portion having a center of curvature and connected via a cylindrical portion to the sintered plate by means of enamel, while the incandescent body surrounds the center of curvature. The incandescent body is usually arranged transversely to the sintered plate on a centerline of the bulb. In a favorable embodiment, the cylindrical portion and an adjoining portion of the end portion have a white, diffusely scattering coating. This embodiment has the advantage that the coating reflects the generated light in a direction away from the sintered plate, and also that a carrier retaining the lamp may be manufactured from a material of low heat resistance because the coating also reflects thermal radiation.

It is alternatively possible for the bulb to have a portion of different shape, for example a parabolic portion or an ellipsoidal portion. The bulb may have a mirroring coating, or alternatively, for example, an IR-reflecting coating for throwing back IR radiation onto the incandescent body.

It is favorable when the sintered plate has an unround edge which projects outside the bulb. The edge may then serve to allow a holder for the lamp, for example a carrier against which the lamp is provided, to grip the lamp. The unround shape of the edge may in that case indicate where the current conductors issue from the sintered plate to the exterior. The unround edge may also serve to position the incandescent body with respect to said edge in directions parallel to the sintered plate. It is favorable when the edge has mutually opposed flat sides. Such flat sides are highly effective for the above purposes and can yet be realized in a simple manner. They may also serve to prevent that a lamp, for example mounted against a carrier, can rotate relative to this carrier.

It is favorable for protecting the environment when both the first and the second glass are at least substantially free from lead. Lead-free glass suitable for the sintered plate is known, for example, from U.S. Pat. No. 5,470,805, and has a composition of substantially: $SiO_2$ 60–72; $Al_2O_3$ 1–5; $Li_2O$ 0.5–1.5; $Na_2O$ 5–9; $K_2O$ 3–7; MgO 1–2; CaO 1–3; SrO 1–5; BaO 7–11; rest <0.5% by weight. Such a glass has a coefficient of linear thermal expansion between 25 and 480 EC of approximately $11*10^{-6}$ $K^{-1}$, a strain point of approximately 460° C. and a softening point of about 680° C. The glass is highly suitable for use in combination with current conductors and with a metal tube of, for example, a nickel-iron alloy. A correspondent lead-free glass for the bulb has a composition of substantially: $SiO_2$ 68–74; $Al_2O_3$ 1–2.5; $Na_2O$ 12–18; $K_2O$ 0.7–1.2; MgO 3–4.5; CaO 6–8; rest <0.5% by weight. Such a glass has a coefficient of linear thermal expansion between 25 and 520 EC of approximately $11*10^{-6}$ $K^{-1}$, a strain point of approximately 500° C. and a softening point of approximately 700° C. Alternatively, the bulb and the sintered plate may be made from hard glass or quartz glass, especially if the filling gas comprises a halogen or a halogen compound.

It is favorable when the sintered plate is plane at its surface facing away from the bulb. This surface may be mounted against a holder, for example a carrier, and accordingly is a suitable surface for serving as a reference for the position of the incandescent body. The surface of the sintered plate which faces the incandescent body has a central elevation in a favorable embodiment, which serves to center the bulb with respect to the sintered plate during lamp manufacture, but which is also useful for positioning a previously shaped ring of enamel material.

In a favorable embodiment, the sintered glass plate has a surface facing the bulb which is wider than a surface facing away from the bulb. The sintered glass plate then has a conically shaped side surface and is then self-locating when the lamp is placed in a holder.

The electric incandescent lamp according to the invention in general consumes a power of approximately 3 to 25 W. The voltage of the lamp in general lies in range of 6 to 30 V, e.g. 13.5 or 24 V. The lamp can have a useful life of at least 2000 h against a luminous efficacy of 18 lm/W.

DETAILED DESCRIPTION OF THE PREFERRED EMBODIMENTS

Figure 1:
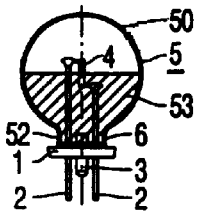
FIG. 1 shows the lamp in side elevation.
Figure 2:
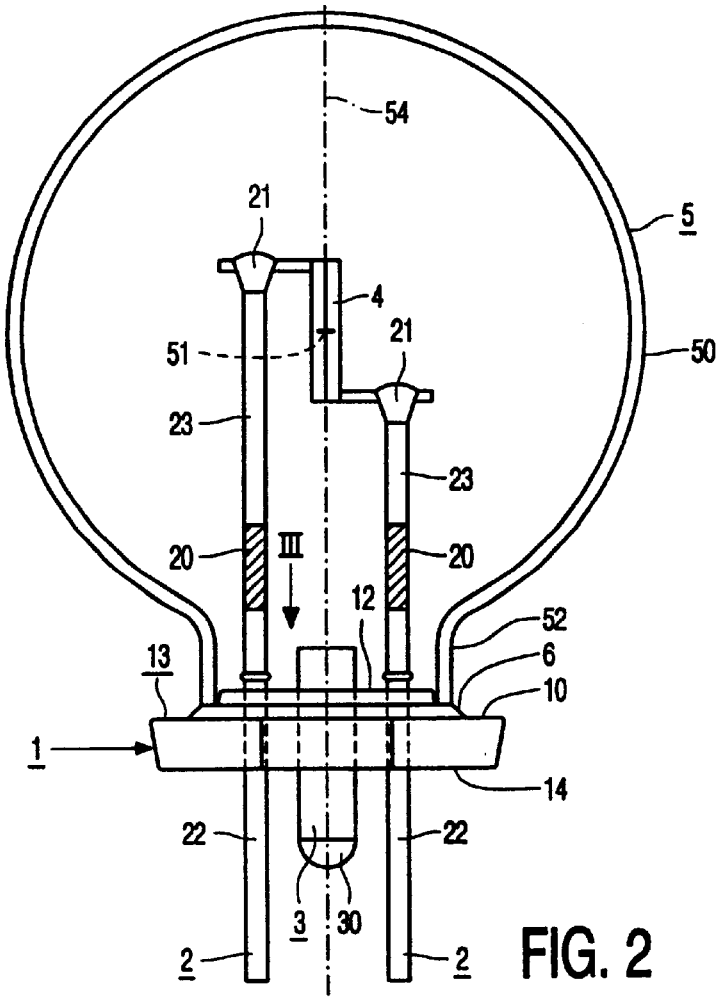
FIG. 2 shows the lamp on an enlarged scale, without coating, in side elevation.

In FIGS. 1 and 2, the electric incandescent lamp has a sintered plate 1 of glass which is connected in a gastight manner to current conductors 2 and to a metal tube 3 which are passed through said plate. An incandescent body 4 is connected to the current conductors 2 and occupies a previously defined position relative to the sintered plate 1. A glass bulb 5 is placed over the incandescent body 4 and is connected to the sintered plate in a gastight manner by means of enamel 6. A filling gas with a pressure of at least 1 bar is present in the bulb 5. The metal tube 3 has a gastight seal 30 outside the bulb 5.

The sintered plate 1 is made of a first glass having coefficient of linear thermal expansion correspondent to the coefficient of linear thermal expansion of the second glass of the bulb 5, the first and the second glass having a coefficient of linear thermal expansion of $11*10^{-6}$ $K^{-1}$. In the drawing, the glass composition of the sintered plate is substantially: $SiO_2$ 67.59; $Al_2O_3$ 3.56; $Li_2O$ 1.27; $Na_2O$ 7.38; $K_2O$ 4.88; MgO 1.24; CaO 1.89; SrO 3.04; BaO 8.81; $CeO_2$ 0.12; $SO_3$ 0.17; rest 0.05% by weight. The strain point and softening point of this glass are respectively 455° C. and 675° C. The glass composition of the bulb is substantially: $SiO_2$ 71.07; $Al_2O_3$ 1.75; $Na_2O$ 15.42; $K_2O$ 0.91; MgO 3.68; CaO 6.90; $Fe_2O_3$ 0.08; $TiO_2$ 0.08; $SO_3$ 0.08; rest 0.03% by weight. The strain point and softening point of this glass are respectively 505° C. and 705° C. The glass of the bulb 5 and the glass of the sintered plate 1 are at least substantially free from lead.

The filling gas has a pressure of 2 to 15 bar at room temperature, in general from 2 to 8 bar, in particular a pressure from 3 to 5 bar, and comprises Xe, Kr, or a mixture thereof, in the Figure krypton to a pressure of 5 bar. The filling gas may comprise a few % of $N_2$ by volume, and possibly halogen or a halogen compound.

A water vapor getter 20 is present in the bulb 5, in the drawing in the form of a coating on both the current conductors 2. The getter is formed by a powder coating of ZrAl, but it may alternatively comprise a coating of, for example, ZrPd.

The seal 30 of the metal tube 3 is a solidified molten metal, in the Figure a drop originating from an end portion of the tube 3 which was melted by means of a discharge arc.

The incandescent body 4 is connected to the current conductors 2 by means of a solidified molten metal 21, in FIG. 2 in that the second part 23 of the current conductor 2 was made to melt locally by means of a laser.

In the drawing, the current conductors 2 each have a weld adjacent the sintered plate 1 between a first part 22 of the conductor which is made of a first metal, for example a nickel-iron-chromium alloy, and which enters the bulb 5 through the sintered plate 1, and a second part 23 made of a second metal and extending towards the incandescent body 4. In FIG. 2, the second part is made of Mo, but it may alternatively be made, for example, of MnNi. The two parts are joined together by means of a butt weld.

The bulb 5 has a spherical end portion 50 having a center of curvature 51 and connected to the sintered plate 1 via a cylindrical portion 52 by means of enamel 6. The incandescent body 4 surrounds the center of curvature 51 and is positioned perpendicularly to the sintered plate 1 so as to coincide with the axis 54 of the bulb 5.

The cylindrical portion 52 and an adjoining portion of the spherical end portion 50 of the bulb 5 have a white coating 53 in FIG. 1. The coating in the Figure was obtained in that a slurry of $TiO_2$, or alternatively $ZrO_2$, was applied.

Figure 3:
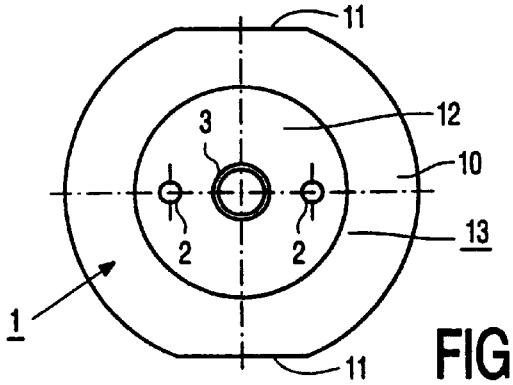
FIG. 3 shows the sintered plate as viewed along the line III in FIG. 2.

The sintered plate 1, see also FIG. 3, has an unround edge 10 which projects outside the bulb 5. The edge 10 has mutually opposed flat sides 11. The sintered plate has a central elevation 12, which centers the bulb 5, at its surface 13 facing the bulb 5. The surface 14 of the sintered plate 1 facing away from the bulb 5 is narrower than is the surface 13, so that the sintered plate 1 has a conical side surface and is self-locating when the lamp is placed in a holder or against a carrier. The incandescent body is vertically aligned with respect to the surface 14 of the sintered plate 1 facing away from the bulb 5, and is aligned in directions parallel to the sintered plate 1 with respect to the flat sides 11.

The lamp is of high quality, as regards accuracy, life, and lumen maintenance, and as regards a highly reliable gastightness. In addition, it is very compact, having a greatest diameter of approximately 16 mm, and a distance of less than 20 mm from the bulb to the outside of the sintered plate.

Figure 4:
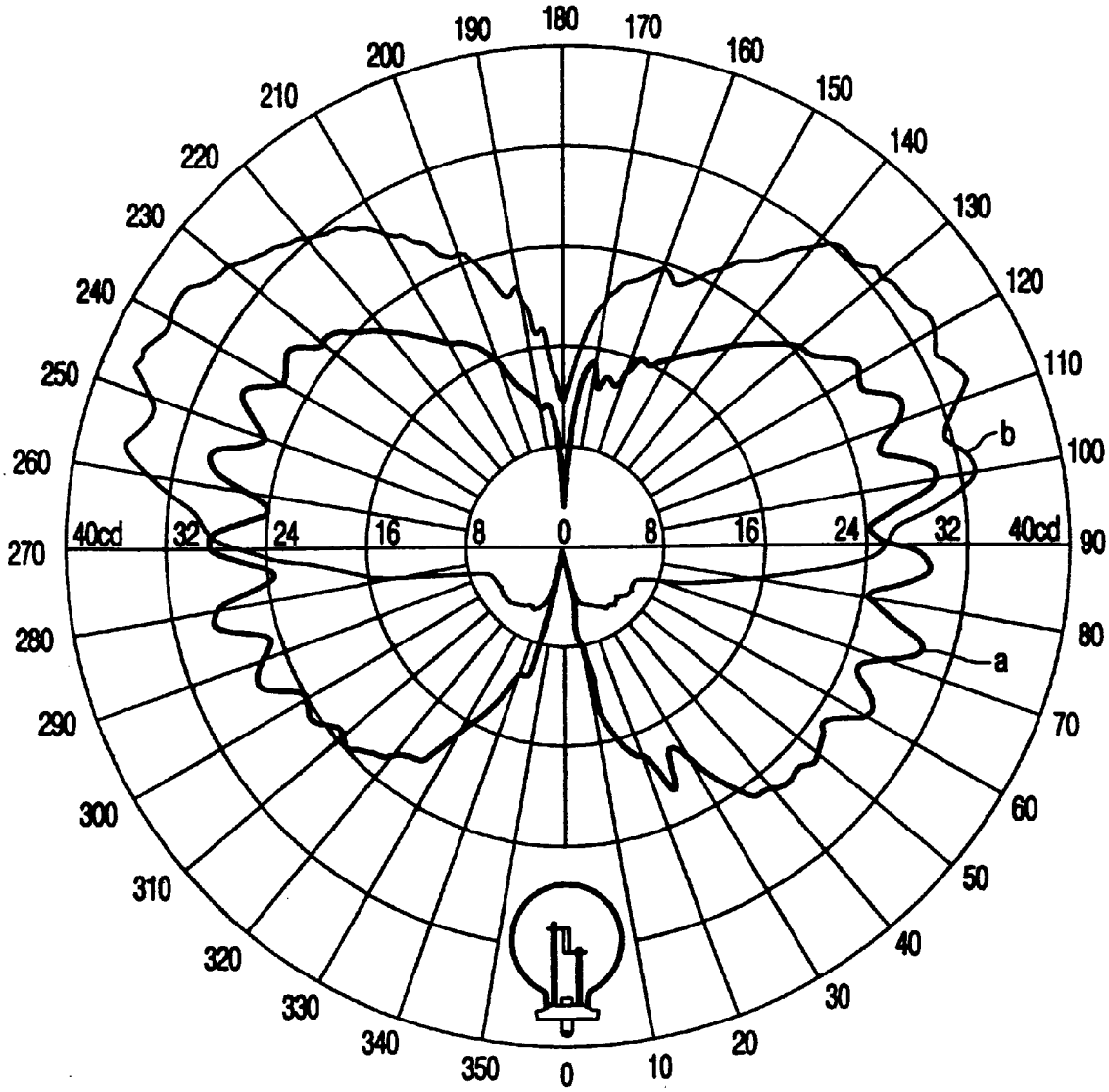
FIG. 4 shows the distribution of the luminous intensity of the lamp.

In FIG. 4, curve a represents the light intensity distribution of a 15 W lamp having a clear bulb, and curve b the same distribution for the same lamp, but provided externally with a diffusely reflecting $ZrO_2$ layer as shown in FIG. 1. The lamp was in the position shown, with the incandescent body in the center of the diagram, during the measurements.

Curve a shows that the lamp having the clear bulb throws practically as much light obliquely forward as obliquely to the rear, where it is in general useless. It is also apparent that the lamp only has a low luminous intensity of approximately 4 cd in a direction straight ahead.

It is apparent from curve b that the coated lamp radiates substantially no light any more to the rear, over the boundary of the coating. Practically all light is radiated obliquely forward, where especially the directions farther ahead benefit from the coating. The intensity has risen to 12 cd in the direction straight forward.

What is claimed is:

1. An electric incandescent lamp comprising:

a shaped glass plate (1) which is connected in a gastight manner to current conductors (2) and to a metal tube (3) which extend through said plate;

an incandescent body (4) occupying a predetermined position relative to the shaped plate (1) and connected to the current conductors (2);

a glass bulb (5) around the incandescent body (4), connected in a gastight manner to the shaped plate (1) by means of enamel (6);

a filling gas having a pressure of at least 1 bar inside the bulb (5), said metal tube (3) having a gastight seal (30) outside the bulb (5), characterized in that the shaped plate (1) is a sintered body made of a first glass and the bulb (5) is made of a second glass, the first glass and the second glass have coefficients of linear thermal expansion which are substantially equal at temperatures below the strain point of the glasses.

2. An electric incandescent lamp as claimed in claim 1, characterized in that the filling gas has a pressure of 2 to 15 bar at room temperature and comprises Xe, Kr, or a mixture thereof, which may comprise $N_2$.

3. An electric incandescent lamp as claimed in claim 2, characterized in that a water vapor getter (20) is present in the bulb (5).

4. An electric incandescent lamp as claimed in claim 3, characterized in that the water vapor getter (20) is a coating on at least one of the current conductors (2).

5. An electric incandescent lamp as claimed in claim 1, characterized in that the seal (30) of the metal tube (3) is a solidified molten metal.

6. An electric incandescent lamp as claimed in claim 1, characterized in that the incandescent body (4) is connected to the current conductors (2) by means of a solidified molten metal (21).

7. An electric incandescent lamp as claimed in claim 6, characterized in that the current conductors (2) each have a weld adjacent the sintered plate (1) between a first conductor part (22) which is made from a first metal and which enters the bulb (5) through the sintered plate (1) and a second part (23) made from a second metal and extending towards the incandescent body (4).

8. An electric incandescent lamp as claimed in claim 1, characterized in that the bulb has a spherical end portion (50) having a center of curvature (51) and connected via a cylindrical portion (52) to the sintered plate (1) by means of enamel (6), the incandescent body (4) surrounding the center of curvature (51).

9. An electric incandescent lamp as claimed in claim 8, characterized in that the cylindrical portion (52) and an adjoining portion of the end portion (50) have a white coating (53).

10. An electric incandescent lamp as claimed in claim 1, characterized in that the sintered plate (1) has an unround edge (10) which projects outside the bulb (5).

11. An electric incandescent lamp as claimed in claim 10, characterized in that the edge (10) has mutually opposed flat sides (11).

12. An electric incandescent lamp as claimed in claim 10, characterized in that the sintered plate (1) has a surface (13) facing the bulb (5) which is wider than a surface (14) facing away from the bulb (5).

13. An electric incandescent lamp as claimed in claim 1, characterized in that the glasses of the bulb (5) and of the sintered plate (1) are at least substantially free from lead.

* * * * *